US005115409A

United States Patent [19]

Stepp

[11] Patent Number: 5,115,409

[45] Date of Patent: May 19, 1992

[54] MULTIPLE-INPUT FOUR-QUADRANT MULTIPLIER

[75] Inventor: Richard Stepp, Munich, Fed. Rep. of Germany

[73] Assignee: Siemens Aktiengesellschaft, Berlin and Munich, Fed. Rep. of Germany

[21] Appl. No.: 393,607

[22] Filed: Aug. 14, 1989

[30] Foreign Application Priority Data

Aug. 31, 1988 [EP] European Pat. Off. ..... 88114225

[51] Int. Cl.[5] ..... G06G 7/163; G06J 1/00

[52] U.S. Cl. ..... 364/841; 307/498; 328/160

[58] Field of Search ..... 364/841, 800, 807; 307/498; 328/160; 330/252, 257

[56] References Cited

U.S. PATENT DOCUMENTS

| | | | |
|---|---|---|---|
| 3,309,508 | 3/1967 | Witt | 235/150.52 |
| 3,670,155 | 6/1972 | Grobert | 364/841 |
| 3,689,752 | 9/1972 | Gilbert | 364/841 |
| 3,838,262 | 9/1974 | van de Plassche | 364/841 |
| 4,071,777 | 1/1978 | Herrmann | 364/841 |
| 4,586,155 | 4/1986 | Gilbert | 364/841 |
| 4,764,892 | 8/1988 | Thomas | 364/841 |

FOREIGN PATENT DOCUMENTS

| | | |
|---|---|---|
| 0145976 | 6/1985 | European Pat. Off. . |
| 0157520 | 10/1985 | European Pat. Off. . |
| 3030115 | 2/1982 | Fed. Rep. of Germany . |

OTHER PUBLICATIONS

"Advanced Electronic Circuits", by Ulrich Tietze et al., 4th Edition; Springer-Verlag New York Heidelberg Berlin, 1980, pp. 227-228.

"Halbleiter-Schaltungstechnik", by Ulrich Tietze et al.; 4th Edition; Berlin, Heidelberg, New York; Springer; 1978, pp. 64-65.

"Analog Signal Processing Components", vol. 1; pp. 6-9 to 6-16; Analog Devices, Inc. Data-Acquisition Databook 1984.

*Primary Examiner*—Jerry Smith
*Assistant Examiner*—Jim Trammell
*Attorney, Agent, or Firm*—Jeffrey P. Morris

[57] ABSTRACT

A four-quadrant multiplier based on a Gilbert cell is utilized to multiply several signals by a similar signal. The transistors in two pairs of coupled differential amplifiers of one input terminal of the inner multiplier that is activated like a Gilbert cell by way of a diode-and-transistor section have several emitters. Each pair of emitters in the right and the left branch of the miltiplier can be oppositely activated by way of a source of variable current or by way of a series of a transistor and a source of current. To process square-wave signals, the source of variable current is a source that can be engaged and disengaged by $I^2L$ gates.

5 Claims, 2 Drawing Sheets

MULTIPLE-INPUT FOUR-QUADRANT MULTIPLIER

BACKGROUND OF THE INVENTION

1. Field of the Invention

The present invention relates to a four-quadrant multiplier with more than two signal inputs for multiplying an input signal by several other input signals such that the results of the separate multiplications appear added together at its output terminal.

Multipliers of this type are advantageously employed, for example, for modulating various signals on the same carrier or for detecting already modulated signals with different frequencies on the same carrier.

2. Description of the Prior Art

Four-quadrant multipliers with two linear signal inputs are described along with their mode of operation on pages 6–9 to 6–16 of Data-Acquisition Handbook 1984, Vol. 1: Integrated Circuits (Analog Devices, Inc.), on page 227 ff., Section 11.41, of U. Tietze and Ch. Schenk, "Halbleiterschaltungstechnik," 5th ed. (1980), etc. These known multipliers are based on what is called a Gilbert cell.

FIG. 1 illustrates a prior art circuit as identified above. Two transistors T1 and T2 and two other transistors T3 and T3 constitute two pairs of differential amplifiers with directly connected emitters. The collector of transistor T1 is connected to the collector of transistor T3 and, by way of a resistor R1, to a supply potential Uv, creating a signal-output terminal +z. The collector of transistor T2 is analogously connected to the collector of transistor T4 and, by way of another resistor R2, to supply potential Uv, creating another signal-output terminal −z. The two signal-output terminals together supply a symmetrical output signal. Since the emitters of transistors T1 and T2 and of transistors T3 and T4 are interconnected with no negative-feedback resistor, the bases of these transistors do not constitute a linear signal-input terminal. To provide a linear signal-input terminal, the base of transistor T1 is connected to the base of transistor T4 and to the collector of a fifth transistor T5 and by way of a diode D1 to a source of current, specifically a third resistor R3, the other terminal of which is at supply potential Uv. The base of transistor T2 is analogously connected to the base of transistor T3, to the collector of a sixth transistor T6, and by way of a second diode D2 to resistor R3, the source of current. The emitters of transistor T5 and transistor T6 are either interconnected by way of a resistor and connected by way of a separate source of current to reference potential or, as illustrated in FIG. 1, interconnected by way of a fourth resistor Rx1 and a fifth resistor Rx2, with the junction between them connected by way of a source I1 of constant current to reference potential (mass). The base of transistor T6 accordingly constitutes one input terminal +x and the base of transistor T5 another input terminal −x of the multiplier. It is possible to introduce a symmetrical input signal through input terminals +x and −x in that the multiplier's transmission properties are linear in relation to this signal input. The emitters of transistors T1 and T2 are connected to the collector of a seventh transistor T7. The emitters of transistors T3 and T4 are connected to the collector of an eighth transistor T8. The emitters of transistors T7 and T8 are interconnected by way of a coupling resistor Ry. The emitter of seventh transistor T7 is connected to reference potential by way of another source I2 of constant current, and the emitter of transistor T8 to reference potential by way of a third source I3 of constant current. The base of seventh transistor T7 constitutes the third input terminal +y and the base of transistor T8 the fourth input terminal −y of the multiplier. It is possible to introduce a symmetrical input signal through input terminals +y and −y in that the multiplier's transmission properties are linear in relation to this signal input as well due to the negative feedback represented by coupling resistor Ry.

Circuits of the above described type are especially appropriate for multiplying at least one digital input signal by another input signal. To obtain a similar multiplier with more than two signal-input terminals, whereby one input signal can be multiplied by several other input signals and the individual results added, it would be possible to connect the corresponding number of known multipliers. This known approach would, however, have drawbacks that would be particularly apparent when the multiplier was used as a detector or modulator.

Although transistors or diodes manufactured in a single step on one chip are generally similar, the slight difference in large-signal behavior, the wide difference between the amplification factors, etc. of the different transistors results in different direct-current voltage offsets in the individual amplification stages, especially when many transistors are connected together, and the individual signal-input terminals in the overall multiplier circuit are variously weighted. Since the direct-current voltage offset already creates problems in such circuits, the superposition of several different direct-current voltage offsets would be particularly detrimental.

Other drawbacks encountered in such known prior art circuits are that they occupy a lot of the surface of the chip and that potentially deleterious track capacities can occur at high frequencies.

SUMMARY OF THE INVENTION

The present invention describes a multiplier for multiplying an input signal by several other input signals with the results of the separate multiplications appearing added together at its output terminal, such that the aforementioned disadvantages of the prior art are either eliminated or are substantially decreased.

This invention is described in detail with reference to the drawings wherein:

Figure 1:
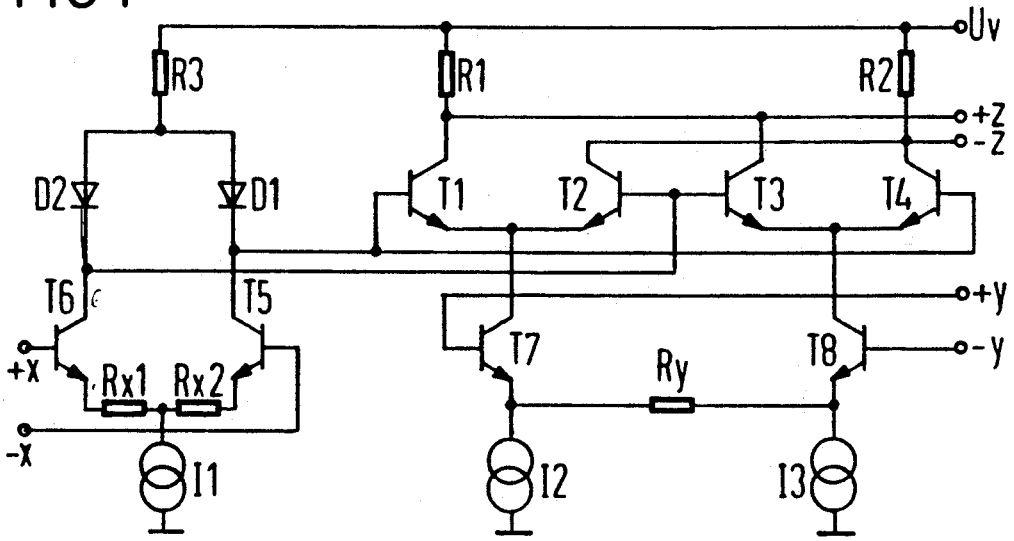
FIG 1 PRIOR ART
FIG. 1 illustrates a multiplier of the prior art.
Figure 2:
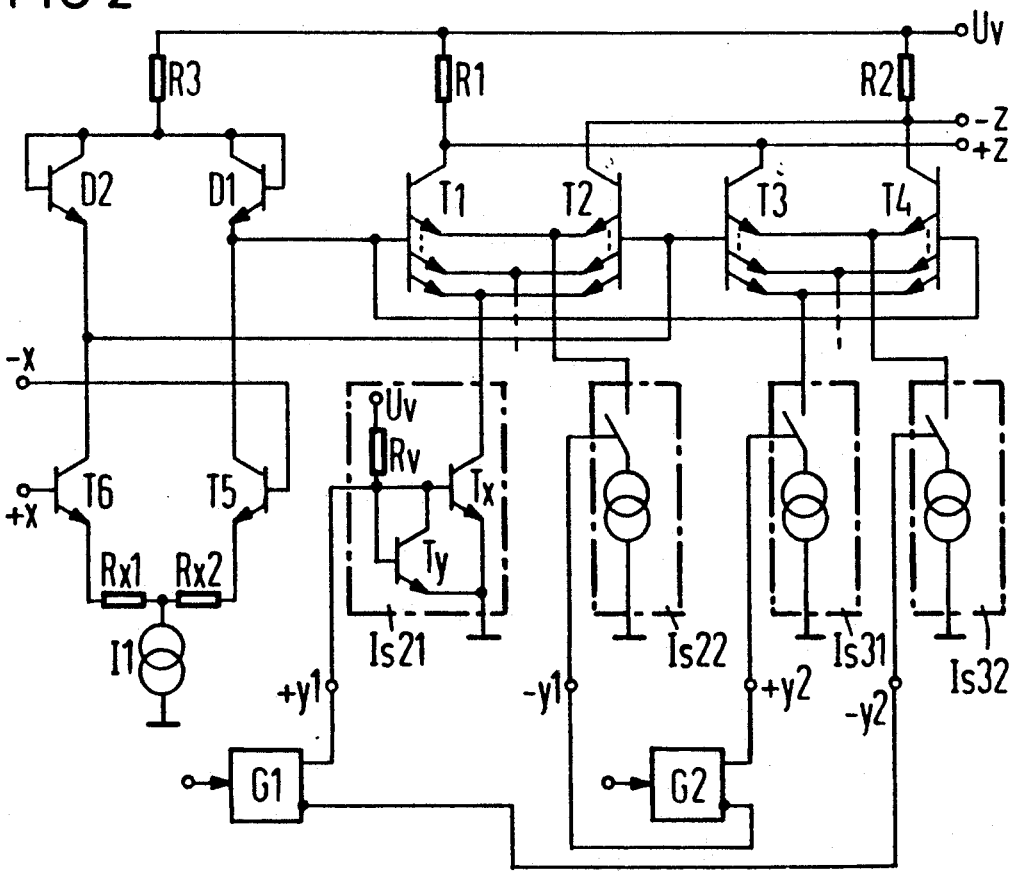
FIG. 2 illustrates a block diagram of the technique of the present invention which is appropriate for processing square or digital signals.
Figure 3:
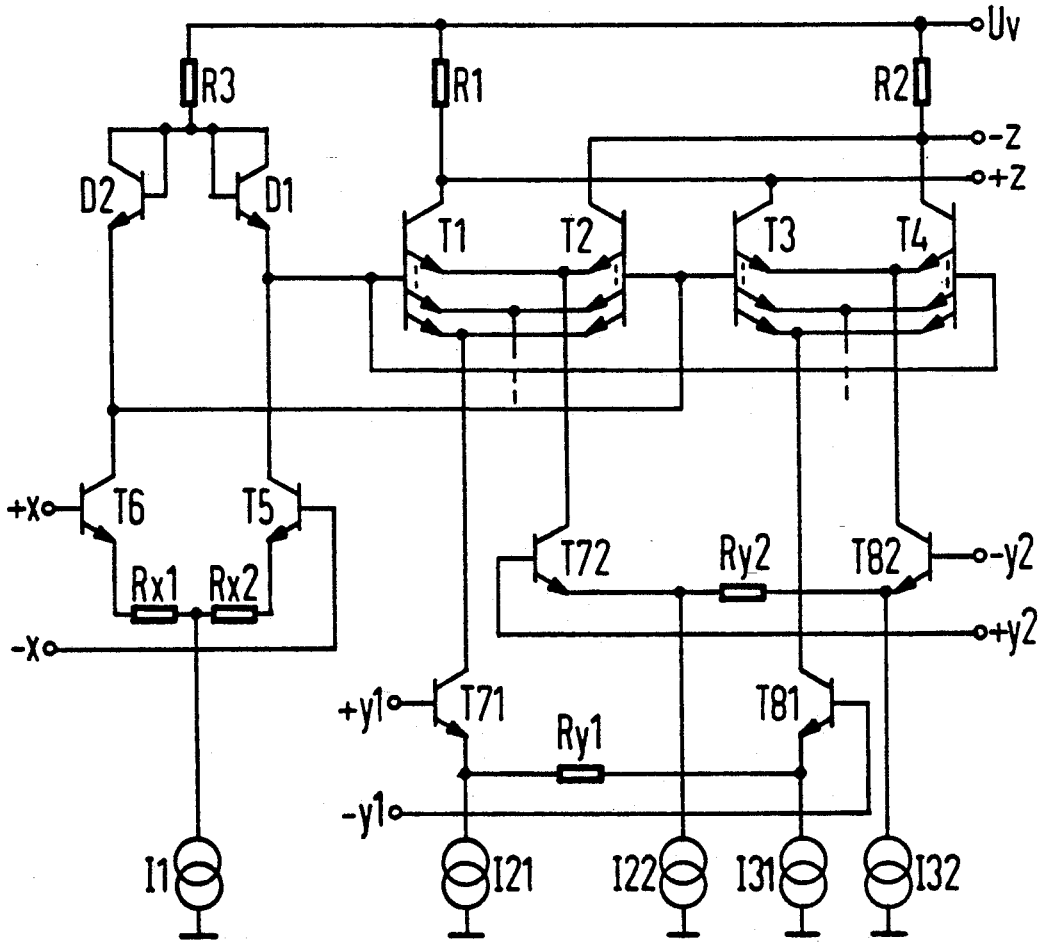
FIG. 3 illustrates a preferred embodiment of the present invention.

Circuit components that have the same or similar function are labeled with the same or a similar reference number in FIGS. 1, 2, and 3. The mode of operation of the circuits illustrated in FIGS. 2 and 3 is operationally similar to that of the described prior art circuit illustrated in FIG. 1, but includes the hereinafter disclosed improvements.

DESCRIPTION OF THE PREFERRED EMBODIMENT

The particular advantage of the circuit in accordance with the present invention is that transistors T1, T2, T3, and T4, which are present in a similar activating circuit in the form of a Gilbert cell, are designed for this special application as multiple-emitter transistors. Thus, the expenditure for circuitry and the chip surface occupied in accordance with the invention is only a little greater than in the case of single-stage multipliers.

The input signal applied to input terminals +x and −x is multiplicatively mixed or multiplied in the linear-activation range with the signals at terminals +y1 & −y1, +y2 & −y2, etc. as is known. Since the collector currents from transistors T1, T2, T3, and T4 always contain the sum of their emitter currents, the individual multiplication products are presented added together at signal-output terminals +z & −z.

Whether the product of the input signal supplied to input terminal +x & −x and of another input signal supplied to another signal-input terminal is added to or subtracted from the products of the input signals applied to input terminal +x & −x and to the remaining signal-input terminals depends only on the mathematical sign of the particular input signal. The input terminals can be interchanged to reverse the sign.

The circuit illustrated in FIG. 3 is especially suitable for applications wherein the transmission behavior of the multiplier should be linear in relation to separate input terminals. This type of transmission behavior is ensured in particular with respect to input terminals +y1 & −y1, +y2 & −y2, etc. by the negative feedback comprising coupling resistors Ry1, Ry2, etc.

Whether the emitters of transistors T5, T6, T7, T8, T71, T81, T72, T82, etc. are each connected by way of a resistor Ry1 etc. to the emitter of the corresponding transistor and by way of a particular source of current to reference potential or whether the emitters are interconnected by way of a series of two resistors Rx1, Rx2, etc., with only the junctions between the resistors connected by way of source of constant current to reference potential is irrelevant to the circuitry in accordance with the invention. As will be evident from pages 64 and 65 of U. Tietze and Ch. Schenk, "Halbleiter-Schaltungstechnik," 4th ed. (1978), the two versions are equivalent. Their effects differ only in that, when there are two sources of current and one resistor per pair of emitters, the resistor carries no current when inactive, so that varying the amplification does not affect rest potential. Which embodiment of the circuit is employed accordingly depends on the specific conditions and is not critical in the case of monolithic integrated circuit.

When signal-input terminals +y & −y, +y1 & −y1, etc. are to be supplied with square-wave signals, the multiplier illustrated in FIG. 2 is particularly advantageously applicable.

It is often sufficient to make sources Is21, Is22, . . . , Is31, Is32, etc. conventional sources of constant current that engage and disengage in accordance with the particular signal level. If the current-input terminal of these sources Is 21 etc. of variable current is the collector of a transistor Tx, the emitter of which is connected to another potential, especially reference potential, and simultaneously to the emitter of another transistor Ty, and the base of which is connected to the base and to the collector of transistor Ty to create a control input terminal for the source, whereby the control input terminal is connected to supply potential Uv by way of a resistor Rv, the control input terminal of this type of current source can be directly activated by the output from a logic gate, especially an $I^2L$ gate G1, G2, etc.

To keep the edges of the square-wave signal clean, one inverting input terminal −y1, −y2, etc. can be activated by the output signal from a logic gate G1, G2, etc. and one non-inverting input terminal +y1, +y2, etc. by an output signal that is the inverse of that output signal.

I claim:

1. A four-quadrant multiplier in the form of a monolithic integrated electronic circuit, comprising:

two signal-output terminals, one of which signal-output terminal consists of a first transistor with its collector connected to the collector of a third transistor and, via a first resistance, to a supply potential; and the other signal-output terminal consisting of a second transistor with its collector connected to the collector of a fourth transistor and, via a second resistance, to the supply potential;

wherein the base of the first transistor is connected to the base of the fourth transistor, to the collector of a fifth transistor, and to the cathode of a first diode; and wherein the base of the second transistor is connected to the base of the third transistor, to the collector of a sixth transistor, and to the cathode of a second diode;

wherein the anode of the first diode is connected, along with the anode of the second diode and via a third resistor, to the supply potential, wherein the emitters of the fifth transistor and of the sixth transistor are coupled to reference potential via a source of constant current, wherein the base of the sixth transistor comprises one of the multiplier's input terminals and the base of the fifth transistor comprises the other input terminal, wherein the first four transistors are multiple-emitter transistors, wherein each emitter of the first transistor is connected to one emitter of the second transistor and to the current-input terminal of a source of variable current, wherein the current-output terminal of the respective source of variable current is connected to reference potential, wherein the control-input terminal of each of said respective sources of variable current are non-inverting input terminals, such that each emitter of the third transistor is connected to a corresponding emitter of the fourth transistor and to the current-input terminal of an individual source of variable current, such that each current-output terminal of each of said respective sources of variable current is connected to reference potential, and wherein the control-input terminals of said sources of variable current are inverting input terminals.

2. A four-quadrant multiplier in accordance with claim 1, wherein the first four transistors are substantially identical multiple-emitter transistors, such that each emitter of the first transistor is connected to a corresponding emitter of the second transistor and to the collector of a seventh transistor, wherein each emitter of the third transistor is connected to one emitter of the fourth transistor and to the collector of an eighth transistor, wherein the emitter of each of said transistors having its collector connected to an emitter of the first transistor is connected via a coupling resistor to one emitter of a transistor with its collector connected to the emitter of the third transistor, wherein the terminals of each coupling resistor are connected, via a separate source of constant current, to reference potential, such that the base of the seventh transistor and the bases of the other like connected transistors are non-inverting input terminals, and wherein the base of the eighth transistor and the bases of the other transistors are inverting input terminals.

3. A monolithic integrated four-quadrant multiplier in accordance with claim 1, wherein the sources of variable current connected to the inverting and non-inverting input terminals are in the form of sources of constant current which can be coupled and decoupled, and wherein square-wave signals are applied to the signal inputs formed by the corresponding input terminals.

4. A monolithic integrated four-quadrant multiplier in accordance with claim 1, wherein each of the non-inverting input terminals other than the first non-inverting input terminal is connected to one output terminal of a particular $I^2L$ gate, wherein each of the inverting input terminals other than the second inverting input terminal is connected to the other output terminal of said particular $I^2L$ gate, such that the inverse signal is added to the signal appearing at the first output terminal, whereby each input terminal of a particular gate is provided with a square-wave signal that is related to reference potential.

5. A four quadrant multiplier in accordance with claim 1, wherein the emitters of the fifth transistor and of the sixth transistor are interconnected via a fourth resistor and a fifth resistor, wherein the junction between the fourth and fifth resistors is coupled to reference potential via said source of constant current.

* * * * *